US012116908B2

(12) United States Patent
Nix

(10) Patent No.: US 12,116,908 B2
(45) Date of Patent: Oct. 15, 2024

(54) SYSTEM FOR UTILIZING A THERMOMECHANICAL CYCLE TO DRIVE A COMPRESSOR

(71) Applicant: INNIO Waukesha Gas Engines Inc., Waukesha, WI (US)

(72) Inventor: Lorne Eugene Nix, Waukesha, WI (US)

(73) Assignee: INNIO Waukesha Gas Engines Inc., Waukesha, WI (US)

( * ) Notice: Subject to any disclaimer, the term of this patent is extended or adjusted under 35 U.S.C. 154(b) by 71 days.

(21) Appl. No.: 17/889,762

(22) Filed: Aug. 17, 2022

(65) Prior Publication Data

US 2024/0060433 A1 Feb. 22, 2024

(51) Int. Cl.

| | |
|---|---|
| ***F01K 13/00*** | (2006.01) |
| ***F01K 13/02*** | (2006.01) |
| ***F01K 23/14*** | (2006.01) |
| ***F01K 25/10*** | (2006.01) |

(52) U.S. Cl.
CPC ..... *F01K 23/14* (2013.01); *F01K 13/02* (2013.01); *F01K 25/103* (2013.01)

(58) Field of Classification Search
CPC ..... F01K 23/14; F01K 13/02; F01K 25/103
See application file for complete search history.

(56) References Cited

U.S. PATENT DOCUMENTS

| | | | | |
|---|---|---|---|---|
| 8,992,838 | B1 | 3/2015 | Mueller | |
| 9,334,109 | B1 | 5/2016 | Mueller et al. | |
| 9,764,255 | B1 | 9/2017 | Mueller | |
| 9,776,155 | B1 | 10/2017 | Mueller et al. | |
| 10,493,382 | B1 * | 12/2019 | Vernon | B01D 19/0063 |
| 10,989,215 | B2 | 4/2021 | Zhang et al. | |
| 2003/0089110 | A1 * | 5/2003 | Niikura | F02G 5/02 60/599 |
| 2004/0031263 | A1 * | 2/2004 | Binder | F01N 3/2066 60/301 |
| 2008/0041046 | A1 * | 2/2008 | Bering | F02B 29/0443 60/599 |
| 2009/0211253 | A1 * | 8/2009 | Radcliff | F01K 23/065 60/670 |
| 2011/0192163 | A1 * | 8/2011 | Kasuya | F01N 5/02 60/624 |
| 2013/0199178 | A1 * | 8/2013 | Kanou | F01K 23/065 60/605.2 |
| 2013/0333636 | A1 * | 12/2013 | Geradts | F01N 5/025 123/2 |
| 2014/0166132 | A1 * | 6/2014 | Roberts | F04B 49/065 137/557 |

(Continued)

OTHER PUBLICATIONS

"Vapor Recovery Systems", Cimarron Energy, Inc., ISNetworld, 2022, 5 pgs, https://cimarron.com/environmental-solutions/vapor-recovery-systems/.

(Continued)

*Primary Examiner* — Matthew T Largi
(74) *Attorney, Agent, or Firm* — Fletcher Yorder, P.C.

(57) ABSTRACT

A system includes a compressor that compresses a fluid. The system also includes an internal combustion engine including a thermomechanical cycle. The thermomechanical cycle converts excess heat from the internal combustion engine to mechanical power to drive the compressor.

15 Claims, 7 Drawing Sheets

(56) References Cited

U.S. PATENT DOCUMENTS

| | | | | |
|---|---|---|---|---|
| 2015/0033737 | A1* | 2/2015 | Mitri | F01K 25/08 60/614 |
| 2017/0298866 | A1* | 10/2017 | Goricanec | F02G 5/04 |
| 2018/0087786 | A1* | 3/2018 | Williams | F25B 25/005 |
| 2020/0392883 | A1* | 12/2020 | Semke | F01N 3/0205 |

OTHER PUBLICATIONS

"Vapor Recovery Unit", Generon, Dec. 18, 2020, 3 pgs, https://www.generon.com/generon-vapor-recovery-unit-shipped-nigeria/.
"Vapor Recovery Unit (VRU)", Forum Energy Technologies, Inc., 2022, 2 pgs, https://f-e-t.com/production-equipment/gas-processing-treating-midstream/vapor-recovery-unit/.
"Eliminate Routine Flaring with ZerO2", EcoVapor Recovery Systems, 2022, 8 pgs, https://ecovaporrs.com/environmental-performance-solutions/zero2-flare-elimination/.
"Reducing Methane Emissions: Best Practice Guide—Flaring", Methane Guiding Principles, Nov. 2019, 22 pgs, https://methaneguidingprinciples.org/wp-content/uploads/2019/11/Reducing-Methane-Emissions-Flaring-Guide.pdf.
"Evaluation of Innovative Methane DetectionTechnologies", Appendix B—Characterization—Additional Material, Interstate Technology Regulatory Council, Sep. 28, 2018, 40 pgs, https://methane-1.itrcweb.org/appendix-b-characterization-additional-material/.
"Cost of Flaring Abatement", Final Report, Rystad Energy, Jan. 31, 2022, 112 pgs, Norway, http://blogs.edf.org/energyexchange/files/2022/02/Attachment-W-Rystad-Energy-Report_-Cost-of-Flaring-Abatement.pdf.
"Natural Gas Compressor Station Baumgarten" by OMV and dated Sep. 1, 2016, https://www.youtube.com/watch?v=uplpxXXJXZw.
"Natural Gas Compressor Station Site Equipment Overview [Oil & Gas Basics]" by Kimray Inc. and dated Dec. 1, 2021, https://www.youtube.com/watch?v=vUpqGBaofGs.

* cited by examiner

SYSTEM FOR UTILIZING A THERMOMECHANICAL CYCLE TO DRIVE A COMPRESSOR

BACKGROUND

The subject matter disclosed herein relates to power cycles (e.g., industrial engine) and, more particularly, to utilizing a thermomechanical cycle of a power cycle to drive a compressor to compress a fluid.

A combustible gas production site may include various systems and components that work independently and/or together to generate a combustible gas that may be delivered downstream to a customer. For example, a combustible gas production site may include a pipeline servicing system, a cleaning system, a measuring system, a compression system, a cooling system, a drying system, and the like, and each system may include various components (e.g., compressors, pumps, engines) that process the combustible gas before delivering the combustible gas to the customer. During operation, portions of the combustible gas may be lost at various points along the production process. These combustible gas losses from various systems and components across a combustible gas production site, typically called "fugitive gases or fugitive emissions," are normally not captured and instead are passed to the atmosphere either in a combusted or uncombusted state. Accordingly, it is now recognized that a need exists to improve a combustible gas production site's ability to capture fugitive gases from each of the various systems and components employed by the combustible gas production site. In this way, the combustible gas production site may recirculate the captured fugitive gases back into the production process, thereby enabling the site to improve total process efficiency, reduce costs, and reduce environmental impact In addition, power cycles located on the combustible gas production site (which may be utilized with one or more systems on-site) may not operate efficiently. For example, excess heat generated by the power cycle may not be utilized resulting in a power cycle with poorer total efficiency. Accordingly, it is now recognized that a need exists to improve the total efficiency of each of these power cycles on the combustible gas production site.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In a first embodiment, a system is provided. The system includes a compressor compresses a fluid. The system also includes an internal combustion engine including a thermomechanical cycle. The thermomechanical cycle converts excess heat from the internal combustion engine to mechanical power to drive the compressor.

In a second embodiment, a non-transitory computer-readable medium is provided. The computer-readable medium includes processor-executable code that when executed by a processor, causes the processor to perform actions. The actions include receiving feedback from one or more sensors of a plurality of sensors disposed within a gas compression site or a combustible gas production site and monitoring a plurality of parameters related to a fugitive gas and/or an internal combustion engine. The actions also include providing one or more control signals to adjust an amount of mechanical power provided to the vapor recovery unit to compress the fugitive gas from the gas compression site or the combustible gas production site. The mechanical power is provided from a thermomechanical cycle of the internal combustion engine that converts excess heat from the internal combustion engine to mechanical power to drive the vapor recovery unit.

In a third embodiment, a method for operating a vapor recovery unit is provided. The method includes receiving, at a controller, feedback from one or more sensors of a plurality of sensors disposed within a gas compression site or a combustible gas production site and monitoring a plurality of parameters related to a fugitive gas and/or an internal combustion engine. The method also includes providing, via the controller, one or more control signals to adjust an amount of mechanical power provided to the vapor recovery unit to compress the fugitive gas from the gas compression site or the combustible gas production site. The mechanical power is provided from a thermomechanical cycle of the internal combustion engine that converts excess heat from the internal combustion engine to mechanical power to drive the vapor recovery unit.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

Figure 1:
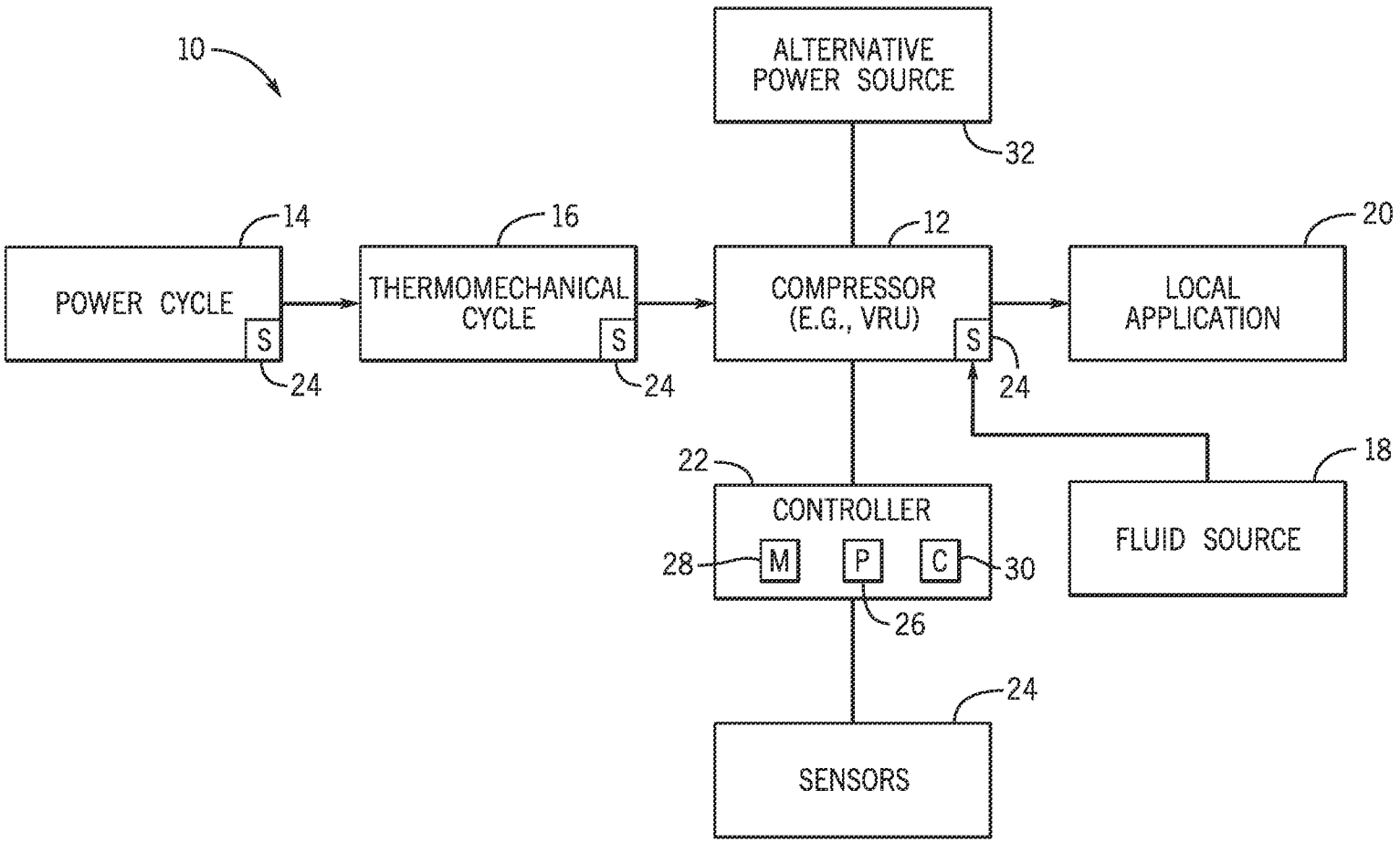
FIG. 1 is a schematic diagram of a system for utilizing waste heat to drive a compressor, in accordance with aspects of the present disclosure.

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

It is now recognized that traditional combustible gas production sites employing power cycles such as combustion engines (e.g., stationary internal combustion engines and/or gas turbine engines) and other systems and components that process combustible gases may not adequately utilize the portions of the combustible gases that are released during operation of the combustible gas production site. For example, combustible gas production sites may employ a number of different sub-systems and components that perform various functions to generate a combustible gas that may be delivered to customers. During operation of the different sub-systems (e.g., pipeline system, cleaning system, measuring system, compression system, cooling system, drying system, and the like) and components (e.g., combustion engines, compressors, pumps), portions of combustible gas flowing through each of the sub-systems and components may be lost at various points along the production process. In traditional combustible gas production sites, these combustible gas losses across a combustible gas production site, typically called "fugitive gases," are not captured and instead are released to the atmosphere via venting or flaring. Thus, it is now recognized that improved systems and methods for capturing and utilizing fugitive gases from a combustible gas production site are desired.

In addition, these power cycles generate a lot of heat that is underutilized as it has no purpose in gas compression. Thus, these power cycles have a reduced efficiency. Typically, vapor recovery units located on a combustible gas production site are typically electrically driven but electrical power is not guaranteed. In some cases, the vapor recovery units may be driven by a small reciprocating internal combustion engine. Thus, it now recognized that systems and methods for improving the total efficiency of the power cycles while providing a reliable power source for vapor recovery units are desired.

Embodiments of the present disclosure enables excess heat (e.g., waste heat) of a power cycle (e.g., engine system such as an internal combustion engine or a gas turbine engine) to be utilized in a thermomechanical cycle (e.g., bottoming thermodynamic cycle) to convert the excess heat to mechanical power to drive a compressor to compress a fluid. In certain embodiments, the compressor may compress fugitive gases from a gas compression site or a gas combustible gas production site to increase a pressure of the fugitive gases to at least above a minimal useful system pressure for a readily available application or local application in the site to enable the fugitive gases to be utilized in the downstream application. In certain embodiments, the compressor may compress a pipeline gas (e.g., natural gas) from a pipeline gas source. In certain embodiments, the compressor may compress hydrogen. In certain embodiments, the compressor may compress air for a pneumatic control supply on-site. In certain embodiments, the compressor may be a vapor recovery unit. The vapor recovery unit may be configured to be fluidly coupled to multiple power cycles. Thus, if one power cycle needs to be down (e.g., due to maintenance, lower site capacity requirements, etc.), the excess heat from another power cycle may be utilized to drive the vapor recovery unit. In certain embodiments, the vapor recovery unit may be initially powered by an alternative power source (e.g., small reciprocating internal engine (i.e., small enough so that doesn't have enough heat rejection to support a secondary thermomechanical cycle and only exists for its designated primary purpose) or electromotor), until the thermomechanical cycle gets up to a temperature that can generate enough power to drive the vapor recovery unit. In certain embodiments, a controller may monitor the level or expected level of fugitive gases to be processed by the vapor recovery unit and may adjust an amount of power provided by the thermomechanical cycle to the vapor recovery unit. The disclosed embodiments enable better utilization of fuel energy by heat recovery, thus, lowering the carbon dioxide equivalent ($CO_2e$) of the power cycle and improving the total efficiency of the power cycle. In addition, the disclosed embodiments enable a reduction in fugitive gases due to recompression. This recompression may occur without needing electrical power.

Turning now to the drawings, FIG. 1 illustrates a schematic diagram of a system 10 for utilizing waste heat to drive a compressor 12. In certain embodiments, the system 10 may be located on a combustible gas production site or a gas compression site. The system 10 includes a power cycle 14 having a thermomechanical cycle 16 (e.g., bottoming thermodynamic cycle) for converting excess heat (e.g., waste heat) from the power cycle 14 to mechanical power to drive or power the compressor 12. In certain embodiments, more than one power cycle 14 having a respective thermomechanical cycle 16 may be coupled to the compressor 12 for powering the compressor 12. In embodiments, with multiple power cycles 14 coupled to the compressor 12, one or more power cycles 14 may be down (e.g., due to maintenance, lower site capacity requirements, etc.) while one or more other thermomechanical cycles 16 of other power cycles 14 drive the compressor 12.

The compressor 12 is configured to compress a fluid (and increase its pressure) from a fluid source 18 for utilization in a downstream application 20. In certain embodiments, the fluid is pipeline gas (e.g., natural gas) from a pipeline source. In certain embodiments, the fluid is hydrogen for a hydrogen source. In certain embodiments, the fluid is air from an air source that may be utilized for a pneumatic control supply on site. In certain embodiments, the fluid is fugitive gases or fugitive emissions from a gas compression site or a combustible gas production site. The fugitive gases may be released from respective flow paths from systems and components utilized on a gas compression site or a combustible gas production site and, in certain embodiments, may be collected by a common disposal header. Fugitive gases are raw natural gas and hydrocarbons whose pressure is near atmospheric pressure or below the pressure of the lowest useful system pressure on-site (i.e., the combustible gas production site 10) (e.g., usually approximately 55 pounds per square in gauge (psig) or 480.5 kilopascal (kPa) (absolute)) or above a fuel supply pressure to the power cycle 14 which may be as low as 30 psig or 308.2 kPA (absolute). Fugitive gases may also include methane, hydrogen, associated petroleum gas, propane, butane, biogas, sewage gas, landfill gas, and coal mine gas. Fugitive gases may also be obtained from a digester, a flare, combustible industrial waste, wood, or other sources. In certain embodiments, the compressor 12 increases the pressure of the fugitive gases to at least above a minimal useful system pressure for a downstream application of a gas compression site or a combustible gas production site to enable the fugitive gases to be utilized in the downstream application. The compressor 12 may compress the fluid utilizing a rotary screw, rotary sliding vane, a reciprocating compressor, or other means for compression. In certain embodiments, the compressor 12 may be a vapor recovery unit.

The power cycle 14 may include an engine system. In certain embodiments, the power cycle 14 may be an internal combustion engine. The internal combustion engine is utilized in stationary application (e.g., industrial power generating engines or stationary reciprocating internal combustion engines). In certain embodiments, the power cycle 14 may be a gas turbine engine. In certain embodiments, the power cycle 14 may be a steam power cycle. The power cycle 14 may be an open cycle or closed cycle.

The source of excess heat (e.g., waste heat) from the power cycle 14 may be the exhaust and/or the engine jacket water. The thermomechanical cycle 16 of the power cycle 14 is in communication with the source of excess heat for converting the excess heat to mechanical power to drive the compressor 12. Each thermomechanical cycle 16 includes at least one heat exchanger in fluid communication with an expander (e.g. piston expander or turbine) to drive a shaft or crankshaft that powers the compressor 12. The thermomechanical cycle 16 can be any type of or combination of thermomechanical cycles 16. For example, the thermomechanical cycle 16 may be a steam Rankine cycle, a supercritical $CO_2$ power cycle, an organic Rankine cycle, a Brayton cycle, a Stirling cycle, an Ericsson cycle, or other thermodynamic cycle. The thermomechanical cycle 16 may be open or closed.

In certain embodiments, a controller 22 may be in communication with or coupled to the compressor 12. The controller 22 is also in communication with or coupled to a plurality of sensors 24. The sensors 24 may be distributed throughout the system 10 (including the power cycle 14, the thermomechanical cycle 16, the fluid source 18, and the compressor 12) and the components and systems of the combustible gas production site or the gas compression site where the system 10 is located. The sensors 24 may be flow or flow rate sensors, temperature sensors, pressure sensors, gas sensors, or any other type of sensor. The sensors 24 may configured to sense or detect various parameters related to a combustible gas production site or gas compression site. The sensors 24 may detect parameters associated with the various systems or components utilized on-site. For example, the sensors 24 may detect parameters related to flow or a pressure of fugitive gases upstream of the compressor 12 (e.g., in a common disposal header). The sensors 24 may also detect parameters of the power cycle 14 (e.g., load, exhaust temperature, etc.) and the thermomechanical cycle 16 (e.g., temperature of working fluid at various points along the cycle).

The controller 22 receives feedback from one or more of the sensors 24 and provides control signals to various components of the system 10 (e.g., the compressor 12, the power cycle 14, and the thermomechanical cycle 16 in response to the feedback. The controller 22 includes a processor 26 operably coupled to a non-transitory computer readable medium or memory 28. The computer readable medium 28 may be wholly or partially removable from the controller 22. The computer readable medium 28 contains instructions used by the processor 26 to perform one or more of the methods described herein. More specifically, the memory 28 may include volatile memory, such as random access memory (RAM), and/or non-volatile memory, such as read-only memory (ROM), optical drives, hard disc drives, or solid-state drives. Additionally, the processor 26 may include one or more application specific integrated circuits (ASICs), one or more field programmable gate arrays (FPGAs), one or more general purpose processors, or any combination thereof. Furthermore, the term processor is not limited to just those integrated circuits referred to in the art as processors, but broadly refers to computers, processors, microcontrollers, microcomputers, programmable logic controllers, application specific integrated circuits, and other programmable circuits. The controller 22 can receive one or more input signals ($input_1 \ldots input_n$), such as from the sensors 24, actuators, and other components and can output one or more output signals ($output_1 \ldots output_n$), such as to the sensors 24, actuators, and other components. The controller 22 also includes communication circuitry 30 configured to communicate with the sensors 24, the actuators, and various components throughout the system 10 (and the site where the system 10 is located).

In certain embodiments, the compressor 12 may be initially driven by an alternative power source 32 (e.g., small reciprocating internal combustion engine or electric motor) when the thermomechanical cycle 16 (e.g., due to working fluid not being up to temperature for generating power) is not able generate sufficient mechanical power to drive the compressor 12. In certain embodiments, upon the thermomechanical cycle 16 being able to generate sufficient power, the compressor 12 both ceases utilizing the alternative power source 32 and switches to utilizing the thermomechanical cycle 16 to power the compressor 12. In certain embodiments, upon the thermomechanical cycle 16 being able to generate sufficient power, torque blending may be utilized where there is a gradual transition between utilizing the alternative power source 32 and the thermomechanical cycle 16 for power so that during this gradual transition both the alternative power source 32 and the thermomechanical cycle 16 are both contributing to varying degrees to the power so that the sum power supply matches the demand. This process may be monitored and regulated by the controller 22 in response to feedback from the sensors 24. In certain embodiments, the alternative power source 32 may not be present. In this case, when the thermomechanical cycle 16 is not able to generate sufficient mechanical power to drive the compressor 12, fugitive gases may be vented to atmosphere, flared with some fugitive gases (e.g., from main fuel lines) designated as high pressure burned as high pressure in a flare and with some fugitive gases (e.g., from a compressor rod packing) designated as low pressure (e.g., near atmospheric pressure) burned as low pressure in a combustor, or directed to a backup compressor (e.g., backup vapor recovery unit run with a small reciprocating internal combustion engine or electric motor). In certain embodiments, the controller 22 may monitor the parameters related to the gas compression site or the combustion gas production site in regulating the power provided to the compressor 12. For example, the controller 22 may receive feedback from one or more of the sensors 24 and provide control signals to adjust an amount of mechanical power provided by the thermomechanical cycle 16 to the compressor 12. In certain embodiments, the power cycle 14 may be sized to generate more power than is needed by the compressor 12. In certain embodiments, the power cycle 14 is sized to provide full power to the compressor 12 for an expected amount of fugitive gas demand and required compression energy.

During routine operation, the compressor 12 may not need to operate at full power or full capacity. When the compressor 12 is operating at less than full power, excess energy (i.e., the excess mechanical power is bled off by the system 10). For example, the excess mechanical power may be diverted to a generator, to belt driven accessories such as a fan for an interstage cooler, or some other function. However, upon the controller 22 receiving feedback from the sensors 24 that a large surge of fugitive gases is occurring, one or more control signals may sent to cease the mechanically bleeding off of the excess energy and diverting the power to the compressor to enable the compressor to operate at full capacity. If the amount of fugitive gases exceed the capacity of the compressor 12, the fugitive gases may be vented to atmosphere, flared, or directed to a backup compressor (e.g., backup vapor recovery unit run with a small reciprocating internal combustion engine or electric motor).

In certain embodiments, when multiple power cycles 14 having respective thermomechanical cycles 16 are coupled to the compressor 12. Each heat exchanger of the respective thermomechanical cycles 16 may be configured to be coupled to a common expander coupled to the compressor 12 via a shaft. Valves may be disposed along conduits between the respective heat exchangers and the common expander. The controller 22 may be in communication with these valves and based on feedback from the sensors 24 provide control signals to actuate (e.g., open/close via actuators) the valves to regulate which of the respective heat exchangers is fluidly coupled to the compressor 12 (and the expander) to drive the compressor 12.

Figure 2:
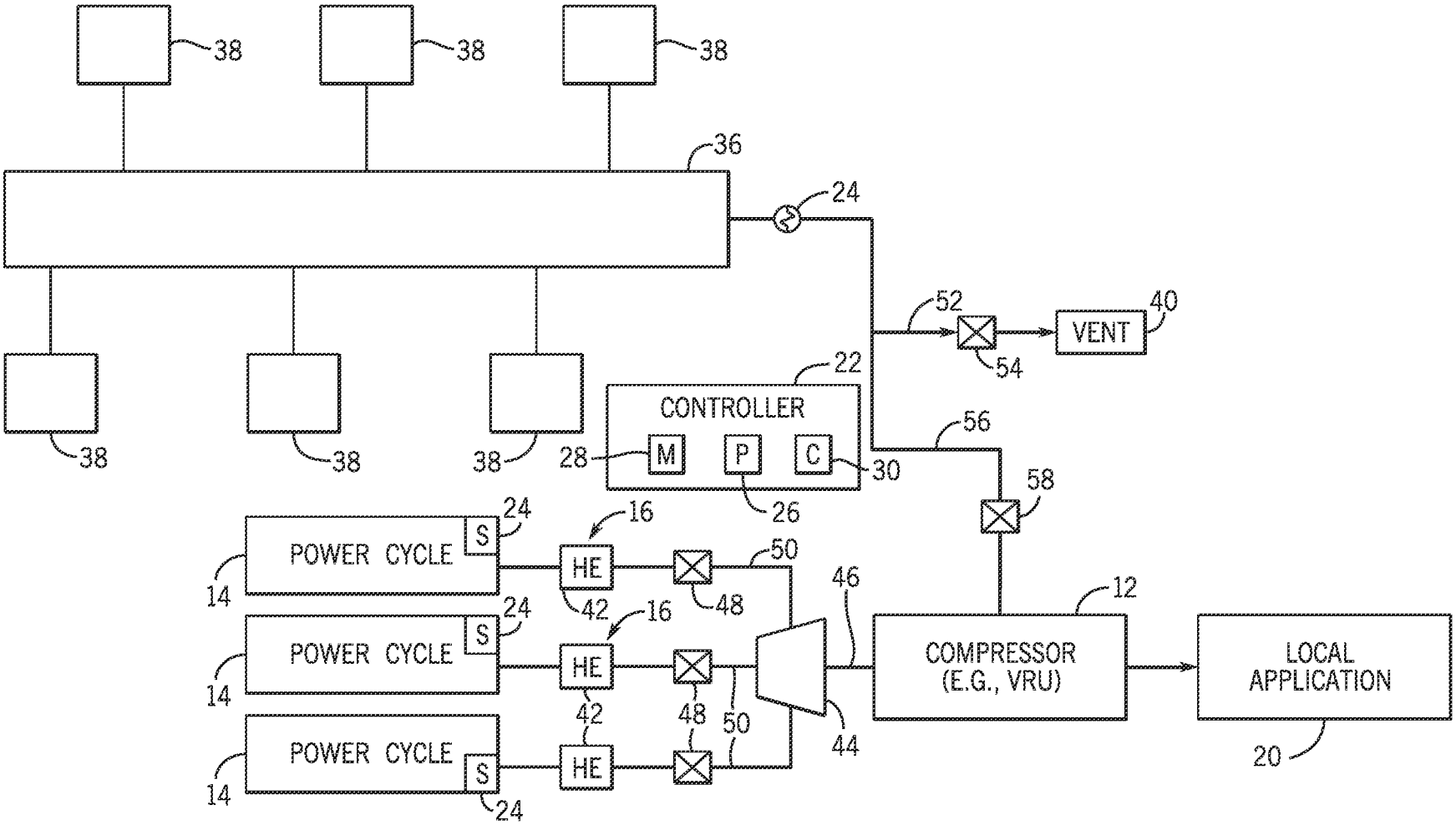
FIG. 2 is a schematic diagram of a combustible gas production site having a common disposal header, where fugitive gases from the combustible gas production site are directed to the system in FIG. 1, in accordance with aspects of the present disclosure.

FIG. 2 is a schematic diagram of a combustible gas production site 34 (or gas compression site) having a common disposal header 36, where fugitive gases from the combustible gas production site 34 are directed to the system 10 in FIG. 1. The combustible gas production site 10 having a number of fugitive gas sources 38. For example, the combustible gas production site 34 may include a pipeline system, a cleaning system, a measuring system, a compression system, a cooling system, a drying system, and the like, and each of the systems may include one or more power cycles (e.g., gas turbine engines or internal combustion engines), compressors, dehydrators, pumps, dryers, conditioning skids, valves, and/or other equipment that may operate independently or in conjunction with other fugitive gas sources 38 to provide a combustible gas (e.g., natural gas) that may be delivered to and consumed by a customer. During operation of the combustible gas production site 34, combustible gases may flow along various flow paths between the different fugitive gas sources 38 within the combustible gas production site 34. In some cases, portions of the combustible gas, referred to herein as fugitive gases, may be released from a respective flow path, and may be collected by the common disposal header 36. Fugitive gases are raw natural gas and hydrocarbons whose pressure is near atmospheric pressure or below the pressure of the lowest useful system pressure on-site (i.e., the combustible gas production site 34) (e.g., usually approximately 55 pounds per square in gauge (psig) or 480.5 kilopascal (kPa) (absolute)) or above a fuel supply pressure to the power cycle 14 which may be as low as 30 psig or 308.2 kPA (absolute). Fugitive gases may also include methane, hydrogen, associated petroleum gas, propane, butane, biogas, sewage gas, landfill gas, and coal mine gas. Fugitive gases may also be obtained from a digester, a flare, combustible industrial waste, wood, or other sources. The common disposal header 36 may be disposed over (e.g., extend across) the combustible gas production site 34 and may be in fluid communication with the one or more fugitive gas sources 38, thereby enabling the common disposal header 36 to receive and deliver the fugitive gases released from the fugitive gas sources 38 of the combustible gas production site 34 to a vent 40 or a compressor 12 (e.g., vapor recovery unit) of the system 10, as described in greater detail below.

The system 10 includes a plurality of the power cycles 14 (e.g., gas turbine engine or internal combustion engine) having respective thermodynamic cycles 16 configured to power the compressor 12 (e.g., vapor recovery unit). Each respective thermomechanical cycle 16 includes a respective heat exchanger 42 coupled to a common expander 44 (e.g., piston expander or turbine). The expander 44 is coupled to the compressor 12 via shaft 46 that drives the compressor 12. A respective valve 48 is disposed along each respective conduit 50 coupling the respective heat exchangers 48 to the expander 44. The controller 22 is in communication with the valves 48 to provide controls signals to actuate (e.g., open or close via actuators) the valves to regulate which of the heat exchangers 48 is utilized in powering the compressor 12. In certain embodiments, one of the power cycles 14 may be down while one or more of the other power cycles 14 are utilized to provide the waste heat to power the compressor 12. The power cycles 14 may be one of the fugitive gas sources 38. In addition, the power cycles 14 may be part of one of the systems on the combustible gas production site 34. For example, the main function of the power cycles 14 may be to drive a compressor for the combustible gas (e.g., natural gas).

The common disposal header 36 is coupled to the vent 40 via a conduit 52. A valve 54 is disposed along the conduit 52 between the vent 40 and the common disposal header 36. When the valve 54 is open, the common disposal header 36 is in fluid communication with the vent 40 to vent the fugitive gas to atmosphere.

The common disposal header 36 is coupled to the compressor 12 via conduit 56. A valve 58 is disposed along the conduit 56 between the compressor 12 and the common disposal header 36. When the valve 58 is open, the common disposal header 36 is in fluid communication with the compressor 12. The compressor 12 compresses the fugitive gases and increases its pressure to at least above a minimal useful system pressure for one or more downstream applications 20 within the combustible gas production site 34. The controller 22 is in communication with the valves 54 and 58 and provides control signals to actuate (e.g., open or close) the valves 54 and 58. In certain embodiments, when the thermomechanical cycles 16 are not able to generate sufficient mechanical power to drive the compressor 12, the valve 58 may be closed and the valve 54 opened to enable the fugitive gases be vented to atmosphere. In certain embodiments, when the thermomechanical cycles 16 are able to generate sufficient mechanical power to drive the compressor, the valve 54 may be closed and the valve 58 opened. In certain embodiments, while the valve 58 is open and the compressor 12 is operating at full capacity, the valve 54 may be opened to enable the fugitive gases to be vented to the atmosphere.

The controller 22 may receive feedback from the sensors 24 (including the sensors 24 associated with the power cycles 14 and the fugitive gases upstream of the compressor 12) to regulate the operation of the compressor 12 and the system 10. In certain embodiments, the controller 22 may regulate the amount of power (e.g., mechanical power) from the thermomechanical cycles 16 utilized to drive the compressor 12.

Figure 3:
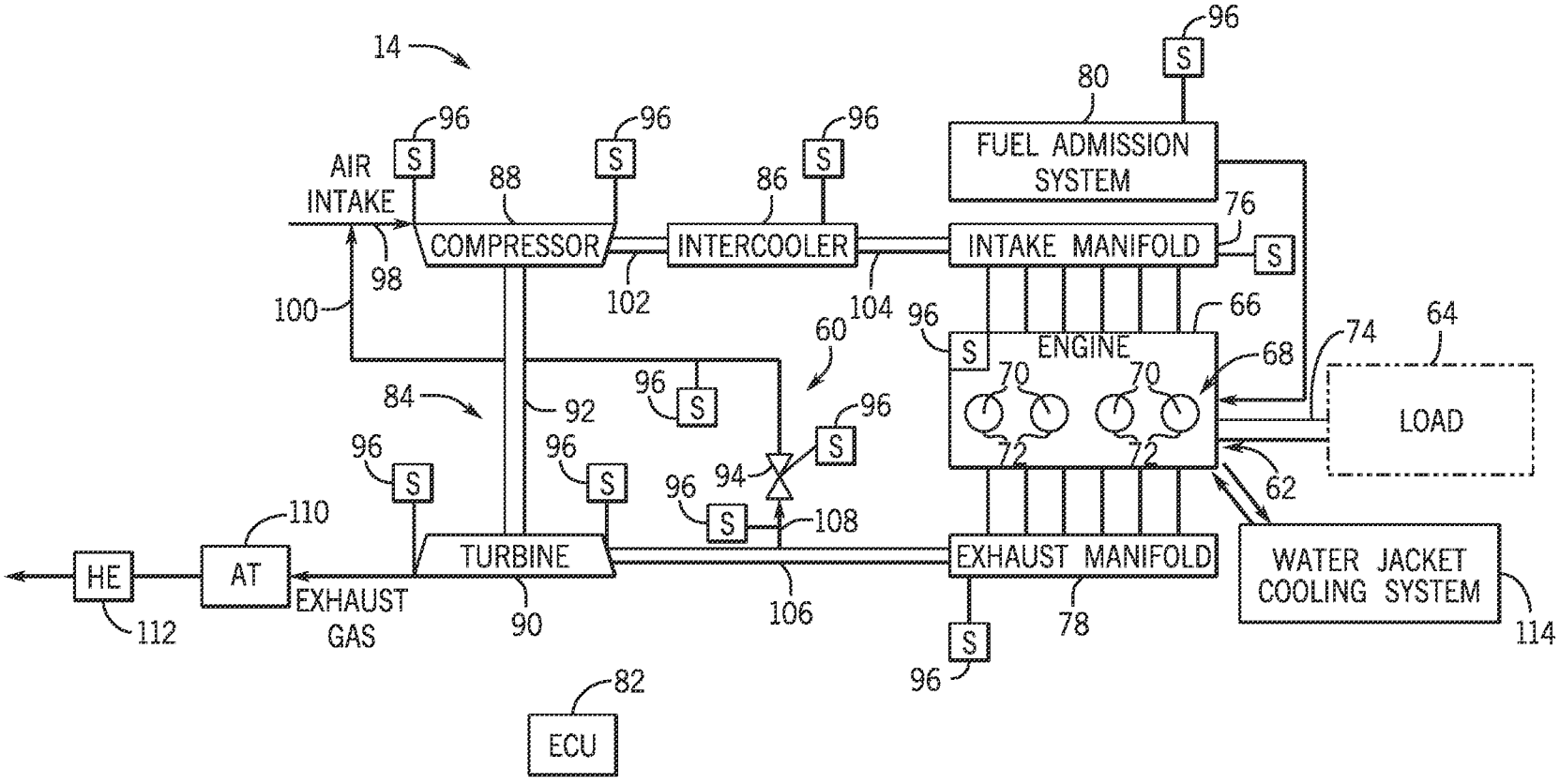
FIG. 3 is a block diagram of a power cycle (e.g., having an exhaust gas recirculation (EGR) system coupled to an internal combustion engine 62, in accordance with aspects of the present disclosure.

FIG. 3 is a block diagram of the power cycle 14 that includes an exhaust gas recirculation (EGR) system 60 coupled to an internal combustion engine 62 (e.g., reciprocating piston-cylinder internal combustion engine). In certain embodiments, the internal combustion engine 62*b* may not include an EGR system 60. Also, the configuration of the EGR system 60 may vary (e.g., where the EGR flow may be taken from (e.g., before or after the turbine 90) or where the EGR flow may be re-introduced (e.g., before or after the compressor 88). In certain embodiments, the EGR system 60 may be a low-pressure EGR system. In certain embodiments, the EGR system 60 may be a high pressure EGR system. The power cycle 14 is a stationary system. The power cycle 14 is utilized to drive a load 64 (e.g., a compressor for compressing a natural gas). The engine 62 may include a two-stroke engine, a four-stroke engine, or other type of reciprocating engine. The engine 62 may also include any number of combustion chambers, pistons, and associated cylinders (e.g., 1-24) in one cylinder bank (e.g., inline) or multiple cylinder banks (e.g., left and right cylinder banks) of a V, W, VR (a.k.a. Vee-Inline), or WR cylinder bank configuration. For example, in certain embodiments, the engine 62 may include a large-scale industrial reciprocating engine having 6, 8, 12, 16, 20, 24 or more pistons reciprocating in cylinders. The fuel utilized by the engine 62 may be any suitable gaseous fuel, such as natural gas, associated petroleum gas, hydrogen ($H_2$, propane ($C_3H_8$), biogas, sewage gas, landfill gas, coal mine gas, butane ($C_4H_{10}$), ammonia ($NH_3$) for example. The fuel may also include a variety of liquid fuels, such as gasoline, diesel, methanol, or ethanol fuel. The fuel may be admitted as a high pressure (blow-through) fuel supply system through either a pre-mixed charge, port admission, or direct injection, or in a combination thereof. The fuel may be admitted as a low pressure (draw-through) fuel supply system (e.g., pre-mixed charge). Or the fuel may be admitted as a combination of a high pressure and low pressure and are both contributing to varying degrees to the fuel requirement so that he sum power supply matches the demand. In some embodiments, the engine 62 may utilize spark ignition, while in other embodiments, the engine 62 may utilize compression ignition.

The engine 62 includes an engine block 66 having a plurality of piston-cylinder assemblies 68, each having a piston 70 disposed within a cylinder 72. Each piston 70 is configured to reciprocate within the cylinder 72 in response to combustion in a combustion chamber of the engine block 66, thereby driving rotation of a crankshaft coupled to a shaft 74 driving the load 64 (e.g., a compressor).

The engine 62 also includes an intake manifold 76, an exhaust manifold 78, a fuel admission system 80, and a controller 82 (e.g., an engine control unit (ECU)). The power cycle 14 also includes a turbocharger 84 and a charge air cooler 86 (e.g., a heat exchanger). The illustrated turbocharger 84 includes a compressor 88 coupled to a turbine 90 via a drive shaft 92. The turbine 90 is driven by exhaust gas to drive the compressor 88, which in turn compresses the intake air and/or EGR flow for intake into the intake manifold 76 after cooling by the charge air cooler 86. The EGR system 60 includes an EGR valve 94 disposed downstream from the exhaust manifold 78 and upstream from the compressor 88. In certain embodiments, the EGR valve 94 may be disposed downstream from the both the exhaust manifold 78 and the compressor 88.

The ECU 82 is coupled to various sensors 96 and devices throughout the power cycle 14 (including the internal combustion engine 62 and the EGR system 60). The sensors 96 may be included among the sensors 24 in FIGS. 1 and 2. The sensors 96 may also be communicatively coupled to the controller 22 in FIGS. 1 and 2. For example, the illustrated controller 82 is communicatively coupled to the EGR valve 94 and the fuel admission system 80. However, the ECU 82 may be coupled to sensors 96 and control features of each illustrated component of the power cycle 14 among many others (e.g., based on operating parameters of the power cycle 14. The sensors 96 may include atmospheric and engine sensors, such as pressure sensors, temperature sensors, speed sensors, and so forth. For example, the sensors may include NOx sensors, oxygen or lambda sensors, engine air intake temperature sensor, engine air intake pressure sensor, jacket water temperature sensor, EGR flow rate sensor, EGR temperature sensor, EGR inlet pressure sensor, EGR valve pressure sensor, EGR temperature sensor, EGR valve position sensor, engine exhaust temperature sensor, and engine exhaust pressure sensor. Other sensors may also include compressor inlet and outlet sensors for temperature and pressure. The ECU 82 may control other devices (e.g., the EGR valve) via one or more actuators.

In the illustrated embodiment of FIG. 3, the power cycle 14 intakes an oxidant, such as air, oxygen, oxygen-enriched air, nitrogen-enriched air, or any combination thereof into the compressor 88 as illustrated by arrow 98. The compressor 88 intakes a portion of the exhaust (e.g., EGR flow) from the exhaust manifold 78 via control of the EGR valve 94 as indicated by arrow 100. In turn, the compressor 88 compresses the intake air and/or the portion of the engine exhaust (e.g., EGR flow) and outputs the compressed gas to the charge air cooler 86 via a conduit 102. The charge air cooler 86 functions as a heat exchanger to remove heat from the compressed gas as a result of the compression process. The charge air cooler 86 may be heat exchanger (e.g., direct or indirect heat exchanger) that utilizes water, air, or another coolant. As appreciated, the compression process typically heats up the intake air and the portion of the exhaust gas, and thus is cooled prior to intake into the intake manifold 76. As depicted, the compressed and cooled air passes from the charge air cooler 86 to the intake manifold 76 via conduit 104. In certain embodiments, the portion of the exhaust (e.g., EGR flow) from the exhaust manifold may be provided into the intake air flow downstream of both the compressor 88 and the intercooler 86 and upstream of the intake manifold 76.

The intake manifold 76 then routes the compressed gas into the engine 62 (e.g., into piston cylinder assemblies). Fuel from the fuel admission system 80 is admitted into the engine 62. The ECU 82 may control the ignition timing so that the combustion is controlled to the appropriate time into the engine cycle. Combustion of the fuel and air (or oxidant) generates hot combustion gases, which in turn drive the pistons 70 (e.g., reciprocating pistons) within their respective cylinders 72.

In turn, the engine 62 exhausts the products of combustion from the various piston cylinder assemblies 68 through the exhaust manifold 78. The exhaust from the engine 62 then passes through a conduit 106 from the exhaust manifold 78 to the turbine 90. In addition, a portion of the exhaust may be routed from the conduit 106 to the EGR valve 94 as illustrated by the arrow 108. At this point, a portion of the exhaust passes to the air intake of the compressor 88 as illustrated by the arrow 100 mentioned above. The ECU 82 controls the EGR valve 94 depending on various operating parameters and/or environmental conditions of the power cycle 14. In addition, the exhaust gas drives the turbine 90, such that the turbine 90 rotates the shaft 92 and drives the compressor 88. The exhaust gas then passes through an exhaust aftertreatment system 110 to reduce exhaust emissions.

In certain embodiments, downstream of the exhaust aftertreatment system 110, a heat exchanger 112 of a thermomechanical cycle (e.g. thermomechanical cycle 16 in FIGS. 1 and 2) interfaces or communicates with the exhaust to transfer thermal energy from the excess heat (e.g., waste heat) of the exhaust to a working fluid of the thermomechanical cycle to be utilized in generating mechanical power to drive a compressor (e.g., compressor 12 in FIGS. 1 and 2). In certain embodiments, a water jacket cooling system 114 may act as heat exchanger (e.g., as part of a thermomechanical cycle such as the thermomechanical cycle 16 in FIGS. 1 and 2) to cool the engine 62 via fluid (e.g., water) circulated through a jacket disposed about the engine 62. The thermal energy of the excess heat (e.g., waste heat) within the fluid utilized to cool the engine 62 is transferred to a working fluid of a thermomechanical cycle to be utilized in generating mechanical power to drive a compressor (e.g., compressor 12 in FIGS. 1 and 2).

Figure 4:
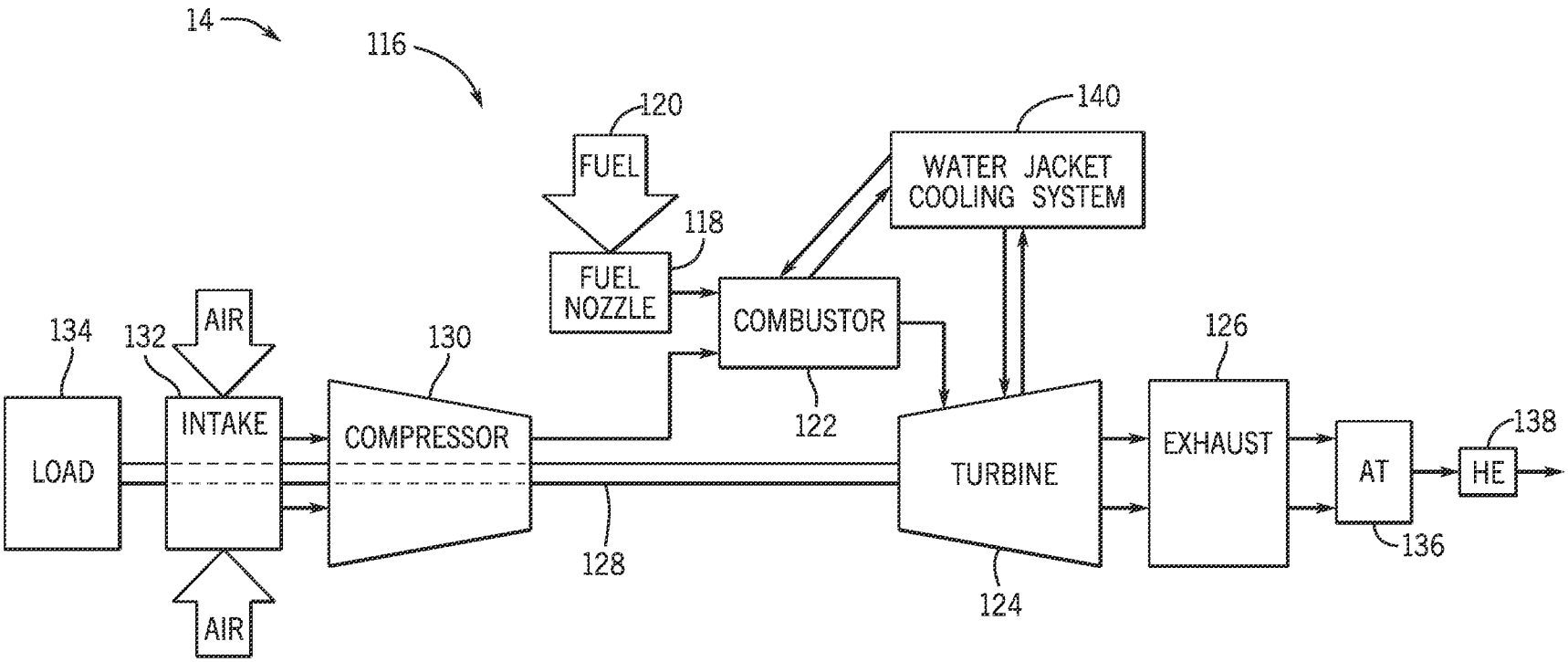
FIG. 4 is a block diagram of a power cycle (e.g., a gas turbine system), in accordance with aspects of the present disclosure.

FIG. 4 is a block diagram of the power cycle 14 that includes a gas turbine engine 116. The gas turbine engine 116 may use liquid or gas fuel, such as natural gas and/or a synthetic gas, to drive the gas turbine engine 116. In certain embodiments, the fuel may include methane, hydrogen, associated petroleum gas, propane, butane, biogas, sewage gas, landfill gas, and coal mine. As depicted, one or more fuel nozzles 118 intake a fuel supply 120, partially mix the fuel with air, and distribute the fuel and the air-fuel mixture into a combustor 122 where further mixing occurs between the fuel and air. The air-fuel mixture combusts in a chamber within the combustor 122, thereby creating hot pressurized exhaust gases. The combustor 122 directs the exhaust gases through a turbine 124 toward an exhaust outlet 126. As the exhaust gases pass through the turbine 124, the gases force turbine blades to rotate a shaft 128 along an axis of the gas turbine engine 116. As illustrated, the shaft 128 is connected to various components of the gas turbine engine 116, including a compressor 130. The compressor 130 also includes blades coupled to the shaft 128. As the shaft 128 rotates, the blades within the compressor 24 also rotate, thereby compressing air from an air intake 132 through the compressor 130 and into the fuel nozzles 118 and/or combustor 122. The shaft 128 may also be connected to a load 134 (e.g., compressor). The load 134 may include any suitable device capable of being powered by the gas turbine engine 116.

After the exhaust gases pass through the exhaust outlet 126, it then passes through an exhaust aftertreatment system 136 to reduce exhaust emissions. In certain embodiments, downstream of the exhaust aftertreatment system 136, a heat exchanger 138 of a thermomechanical cycle (e.g. thermomechanical cycle 16 in FIGS. 1 and 2) interfaces or communicates with the exhaust to transfer thermal energy from the excess heat (e.g., waste heat) of the exhaust to a working fluid of the thermomechanical cycle to be utilized in generating mechanical power to drive a compressor (e.g., compressor 12 in FIGS. 1 and 2). In certain embodiments, a water jacket cooling system 140 may act as heat exchanger (e.g., as part of a thermomechanical cycle such as the thermomechanical cycle 16 in FIGS. 1 and 2) to cool a casing of the combustor 122 and/or a casing of the turbine 124 via fluid (e.g., water) circulated through a jacket disposed about these casings. The thermal energy of the excess heat (e.g., waste heat) within the fluid utilized to cool the casings of the combustor 122 and/or turbine 124 is transferred to a working fluid of a thermomechanical cycle to be utilized in generating mechanical power to drive a compressor (e.g., compressor 12 in FIGS. 1 and 2).

Figure 5:
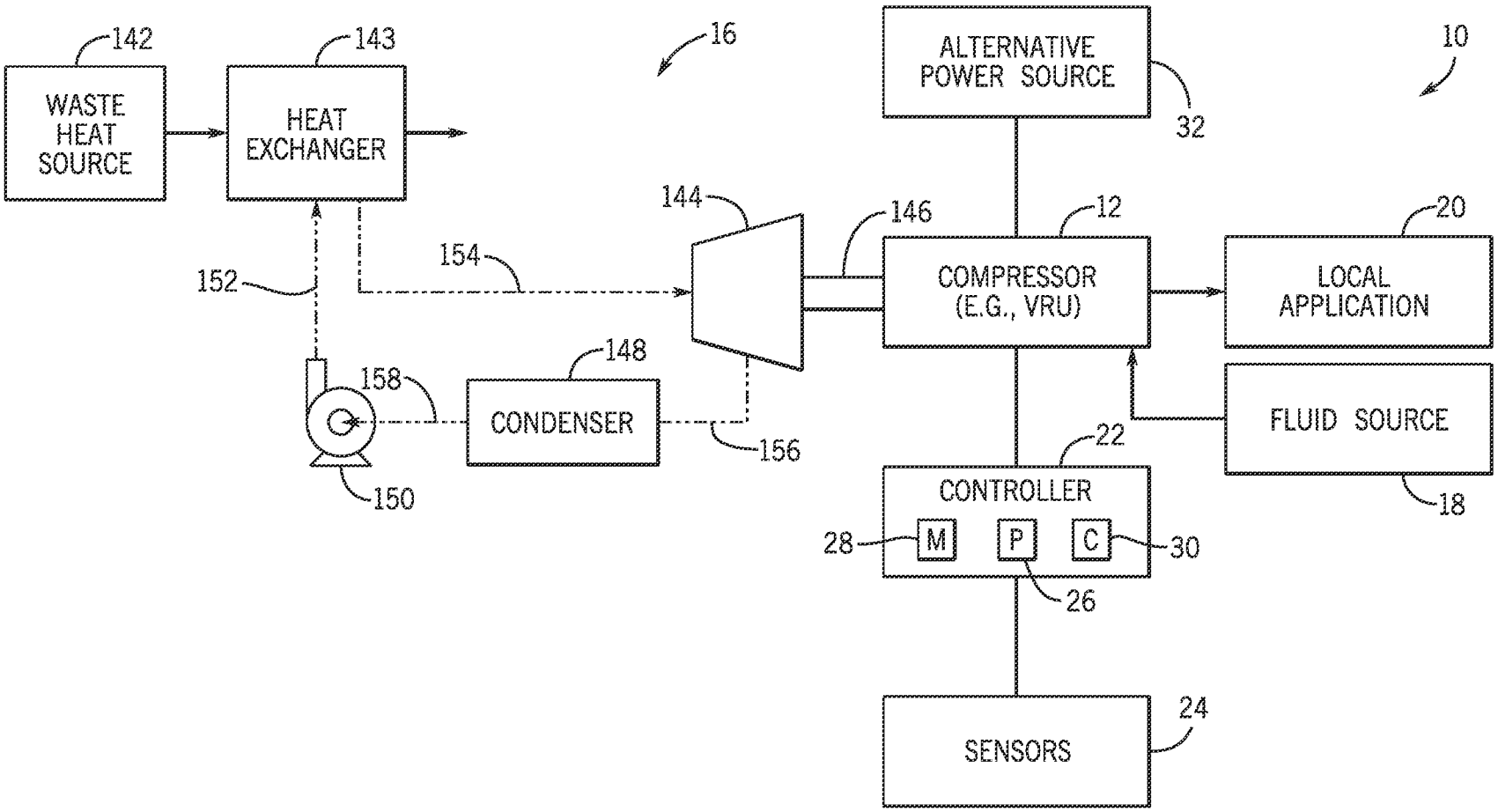
FIG. 5 is a block diagram of a thermomechanical cycle (e.g., steam Rankine cycle or organic Rankine cycle) coupled to a compressor, in accordance with aspects of the present disclosure.
Figure 6:
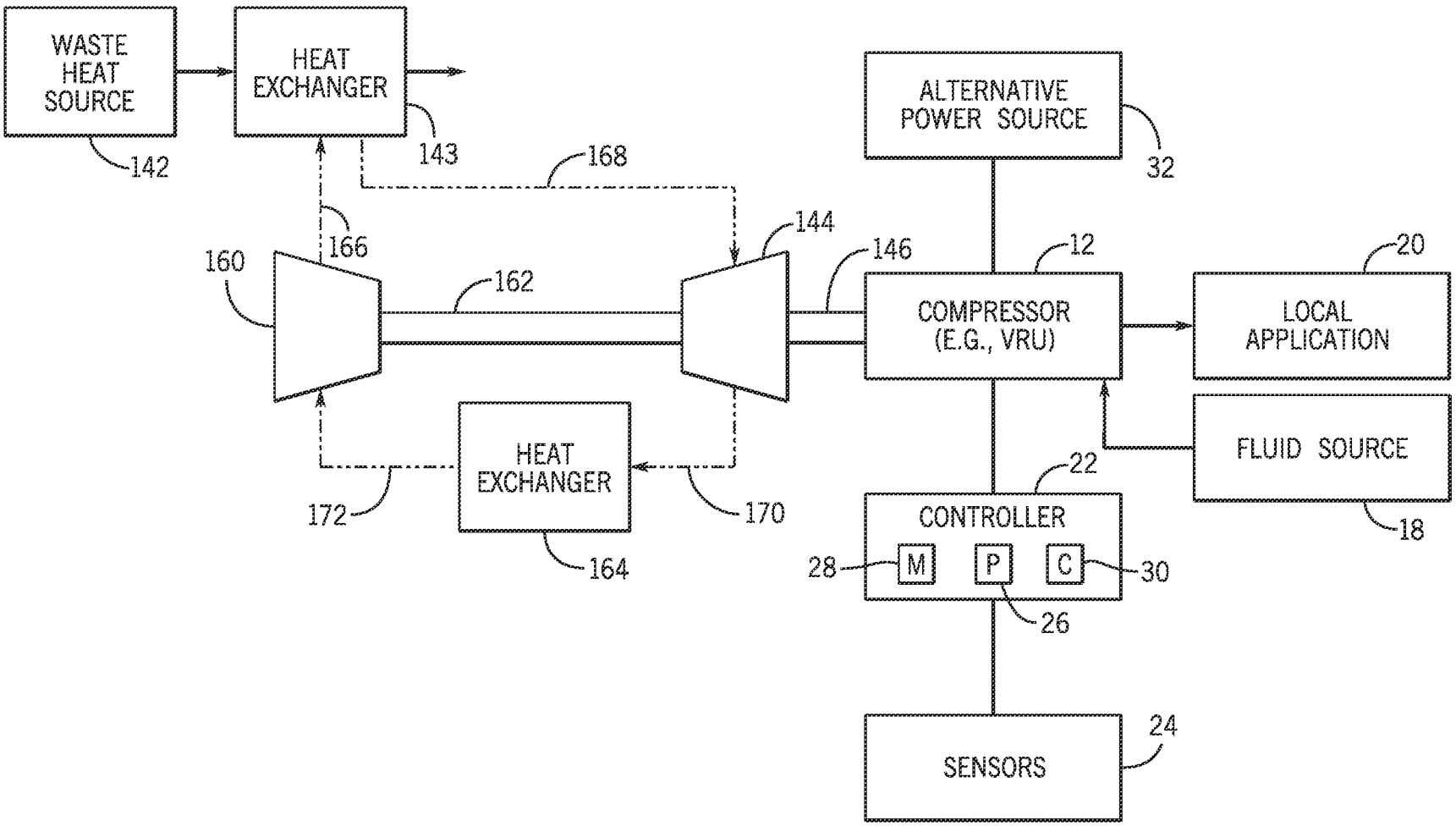
FIG. 6 is a block diagram of a thermomechanical cycle (e.g., Brayton cycle) coupled to a compressor, in accordance with aspects of the present disclosure.
Figure 7:
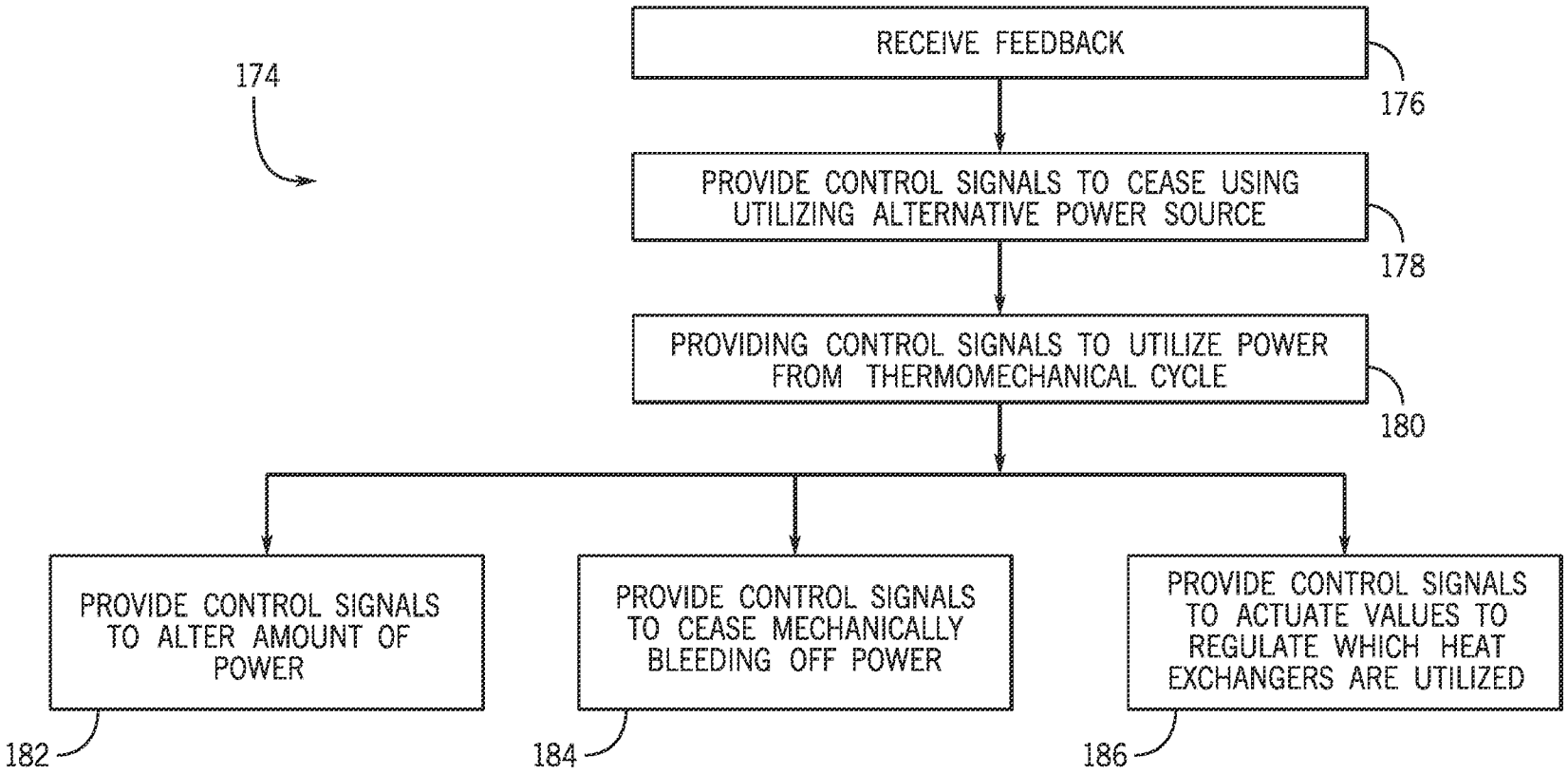
FIG. 7 is a flow chart of a method for operating a compressor (e.g., vapor recovery unit), in accordance with aspects of the present disclosure.

FIGS. 5-7 depict some examples of thermomechanical cycles (e.g., bottoming thermodynamic cycles) that may be utilized in the system 10 described above. These are only some of the possible examples. Other thermomechanical cycles may be utilized. In addition, combinations of the thermomechanical cycles may be utilized. In addition, the thermodynamic cycles may be open or closed cycles.

FIG. 5 is a block diagram of the thermomechanical cycle 16 (e.g., steam Rankine cycle or organic Rankine cycle) coupled to a compressor 12 of the system 10. The system 10 is as described above. As depicted, the thermomechanical cycle 16 is in communication with a waste heat source 142 (e.g., excess heat from the exhaust or engine jacket water of an internal combustion engine or a gas turbine engine) via a heat exchanger 143. The thermomechanical cycle 16 also includes an expander 144 (e.g., piston expander or turbine) coupled to the compressor 12 via a shaft 146 (or crankshaft). The thermomechanical cycle 16 also includes a condenser 148 and a pump 150. The condenser 148 is disposed downstream of the expander 144 between the expander 144 and the pump 150. The pump 150 is disposed between the condenser 148 and the pump 150. The thermomechanical cycle 16 utilizes a working fluid to transfer the thermal energy absorbed by the heat exchanger 143 to the working fluid where it is transferred to the expander 144 where work or mechanical power may be generated to drive the compressor 12.

In a steam Rankine cycle, water is utilized as the working fluid. Water flows along conduit 152 from the pump 150 to the heat exchanger 143, where the thermal energy is transferred to the water to generate steam or vapor. The steam or vapor flows along conduit 154 to the expander 144, where the steam or vapor expands through the expander 144 to generate work. A vapor/liquid mixture then flows from the expander 144 (along conduit 156) to the condenser 148, where the vapor/liquid mixture condenses into water. The water then flows to the pump 150 along the conduit 158, where the pump 150 pressurizes the water.

In an organic Rankine cycle, an organic fluid (e.g., chlorofluorocarbons, hydrochlorofluorocarbons, hydrocarbons, hydrofluorocarbons, perfluorocarbons, etc.) is utilized as the working fluid. Liquid organic fluid flows along conduit 152 from the pump 150 to the heat exchanger 143, where the thermal energy is transferred to the liquid organic fluid to generate a vapor. The vapor flows along conduit 154 to the expander 144, where the vapor expands through the expander 144 to generate work. A vapor/liquid mixture then flows from the expander 144 (along conduit 156) to the condenser 148, where the vapor/liquid mixture condenses into the liquid organic fluid. The liquid organic fluid then flows to the pump 150 along the conduit 158, where the pump 150 pressurizes the liquid organic fluid.

FIG. 6 is a block diagram of the thermomechanical cycle 16 (e.g., Brayton cycle such as a closed Brayton cycle) coupled to a compressor 12 of the system 10. The system 10 is as described above. As depicted, the thermomechanical cycle 16 is in communication with a waste heat source 142 (e.g., excess heat from the exhaust or engine jacket water of an internal combustion engine or a gas turbine engine) via the heat exchanger 143. The thermomechanical cycle 16 also includes the expander 144 (e.g., piston expander or turbine) coupled to the compressor 12 via the shaft 146 (or crankshaft). The thermomechanical cycle 16 includes a compressor 160 coupled to the expander 144 via a drive shaft 162. The thermomechanical cycle 16 also includes a heat exchanger 164 disposed downstream of the expander 144 between the expander 144 and the compressor 160. The condenser 148 is disposed downstream of the expander 144 between the expander 144 and the compressor 160. The thermomechanical cycle 16 utilizes a working fluid to transfer the thermal energy absorbed by the heat exchanger 143 to the working fluid where it is transferred to the expander 144 where work or mechanical power may be generated to drive the compressor 12.

In a Brayton cycle, air or gas may be utilized as the working fluid. A pressurized working fluid flows along conduit 166 from the compressor 160 to the heat exchanger 143, where the thermal energy is transferred to the pressurized working fluid. The hot, pressurized working fluid flows along conduit 168 to the expander 144, where the hot, pressurized working fluid expands through the expander 144 to generate work. The working fluid then flows from the expander 144 (along conduit 170) to the heat exchanger 164, where the working fluid is cooled. In certain embodiments, a recuperator may be disposed between the expander and the heat exchanger 164 to help in cooling the working fluid. The working fluid then flows to the compressor 160 along the conduit 172, where the compressor 160 pressurizes the working fluid.

In a Brayton cycle, supercritical $CO_2$ may be utilized as the working fluid. A pressurized $CO_2$ flows along conduit 166 from the compressor 160 to the heat exchanger 143, where the thermal energy is transferred to the pressurized $CO_2$. The hot, pressurized $CO_2$ flows along conduit 168 to the expander 144, where the hot, pressurized $CO_2$ expands through the expander 144 to generate work. The $CO_2$ then flows from the expander 144 (along conduit 170) to the heat exchanger 164, where the $CO_2$ is cooled. The $CO_2$ then flows to the compressor 160 along the conduit 172, where the compressor 160 pressurizes the $CO_2$. In certain embodiments, a recuperator may be disposed downstream of both the expander 144 and the compressor 160.

FIG. 7 is a flow chart of a method 174 for operating the compressor (e.g., vapor recovery unit) such as the compressor 12 in the system 10 described above. The steps of the method 174 may be performed by one or more components of the system 10 (e.g., controller 22). One or more steps of the method 174 may be performed in a different order from that depicted in FIG. 7 or performed simultaneously.

The method 174 includes receiving feedback (block 176). For example, the controller 22 may receive feedback from sensors disposed throughout the system 10 (e.g., sensors associated with the power cycle 14, thermomechanical cycle 16, the compressor 12, or the fluid source 18 and/or sensors disposed throughout the combustible gas production site or the gas compression site. The feedback from the sensors may relate to the combustible gas production site or the gas compression site (e.g., flow or pressure data related to an expected amount of fugitive gases). The feedback may also relate to whether or not the thermomechanical cycle is up to temperature to enable sufficient mechanical power to drive the compressor 12 (e.g., vapor recovery unit).

In certain embodiments, the compressor 12 (e.g., vapor recovery unit) may be initially powered by an alternative power source (e.g., small reciprocating internal combustion engine or electromotor), until the thermomechanical cycle 16 gets up to a temperature that can generate enough mechanical power to drive the compressor 12. In certain embodiments, the method 174 includes providing one or more control signals (based on the feedback from the sensors) to cease utilizing the alternative power source upon the thermomechanical cycle 16 being able to generate sufficient mechanical power to drive the compressor 12 (block 178). In certain embodiments, the method 174 also includes providing one or more control signals (based on the feedback from the sensors) to switch the thermomechanical cycle 16 to provide the mechanical power to drive the compressor 12 upon the thermomechanical cycle 16 being able to generate sufficient mechanical power to drive the compressor 12 (block 180).

The method 174 also includes providing one or more control signals (based on the feedback from the sensors) to alter an amount of the mechanical power provided to the compressor 12 to compress the fluid (e.g., fugitive gases) (block 182). For example, if a surge in fugitive gases is expected based on the feedback from the sensors, the power from the thermomechanical cycle 16 may be increased to increase the level (e.g., capacity) that the compressor 12 is operating at.

In certain embodiments, the thermomechanical cycle 16 may generate more mechanical power than the compressor 12 needs to handle the current levels of fugitive gases. This excess power may be mechanically bled off by the system 10 (e.g., diverted to a generator, to belt driven accessories such as a fan for an interstage cooler, or some other function). In certain embodiments, the method 174 includes providing one or more control signals (based on the feedback from the sensors) to cease mechanically bleeding off the mechanical power so that the excess power may be diverted to driving the compressor (e.g., during an increase in fugitive gases) (block 184).

In certain embodiments, the system 10 may include multiple power cycles 14 having respective thermodynamic cycles 16 configured to power the compressor 12 (e.g., vapor recovery unit). Each respective thermomechanical cycle 16 includes a respective heat exchanger coupled to a common expander (e.g., piston expander or turbine). Respective valve are disposed along the conduits coupling the heat exchangers to the common expander. In certain embodiments, the method 174 includes providing one or more control signals to these valves to regulate which of the respective heat exchangers is fluidly coupled to the common expander to provide power to drive the compressor 12 (block 186). In certain embodiments, one or more heat exchangers may be fluidly coupled to the common expander at a time.

Technical effects of the disclosed embodiments include providing systems and methods for operating a compressor (e.g., vapor recovery unit) utilizing waste heat from a power cycle utilizing a thermomechanical cycle. The disclosed embodiments enable the $CO_2e$ of the power cycle is lowered, thus, increasing the total efficiency of the power cycle. In addition, the disclosed embodiments enable reduction in fugitive gases or fugitive emissions due to recompression (e.g., via the compressor). This recompression may occur without needing electrical power.

This written description uses examples to disclose the subject matter, including the best mode, and also to enable any person skilled in the art to practice the subject matter, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112 (f).

The invention claimed is:

1. A system, comprising:

a vapor recovery unit that compresses a fugitive gas; and an internal combustion engine comprising a thermomechanical cycle that converts excess heat from the internal combustion engine to mechanical power to drive the vapor recovery unit, wherein the vapor recovery unit comprises an electric motor or a small reciprocating internal combustion engine to initially power the vapor recovery unit until the thermomechanical cycle generates a sufficient mechanical power to drive the vapor recovery unit, and then the vapor recovery unit automatically switches from being powered by the electric motor or the small reciprocating internal combustion engine to being powered by the thermomechanical cycle upon the thermomechanical cycle generating sufficient mechanical power to drive the vapor recovery unit.

2. The system of claim 1, wherein the thermomechanical cycle comprises a steam Rankine cycle, a supercritical carbon dioxide power cycle, an organic Rankine cycle, or a Brayton cycle.

3. The system of claim 1, comprising a plurality of internal combustion engines, wherein each respective internal combustion engine of the plurality of internal combustion engines comprises a respective thermomechanical cycle to convert excess heat from the respective internal combustion engine to mechanical power to drive the vapor recovery unit, wherein each respective thermomechanical cycle of the plurality of internal combustion engines comprises a respective heat exchanger to interface with a source of the excess heat, wherein the system comprises a plurality of valves to fluidly couple the respective heat exchangers to an expander coupled to the vapor recovery unit via a shaft, and the system comprises a controller to provide one or more control signals to actuate the plurality of valves to regulate which of the respective heat exchangers is fluidly coupled to the expander to power the vapor recovery unit.

4. The system of claim 1, wherein the system comprises a plurality of sensors disposed within a gas compression site or a combustible gas production site to monitor a plurality of parameters related to the fugitive gas and/or the internal combustion engine, and the system comprises a controller coupled to the vapor recovery unit, and wherein the controller receives a feedback from one or more sensors of the plurality of sensors and to provide one or more control signals to adjust an amount of the mechanical power provided to the vapor recovery unit to compress the fugitive gas based on the feedback.

5. The system of claim 4, wherein the system mechanically bleeds off excess of the mechanical power not needed by the vapor recovery unit, and the controller communicates the one or more control signals to cease mechanically bleeding off the excess of the mechanical power based on the feedback.

6. The system of claim 1, wherein the internal combustion engine generates full power to the vapor recovery unit via the thermomechanical cycle for a threshold amount of fugitive gas demand and a threshold compression energy.

7. The system of claim 1, wherein the excess heat is collected from engine jacket water, an exhaust of the internal combustion engine, or both the engine jacket water and the exhaust.

8. A non-transitory computer-readable medium, the computer-readable medium comprising processor-executable code that when executed by a processor, causes the processor to:

receive feedback from one or more sensors of a plurality of sensors disposed within a gas compression site or a combustible gas production site and monitoring a plurality of parameters related to a fugitive gas and/or an internal combustion engine;

provide one or more control signals to adjust an amount of mechanical power provided to a vapor recovery unit to compress the fugitive gas from the gas compression site or the combustible gas production site, wherein the mechanical power is provided from a thermomechanical cycle of the internal combustion engine that converts excess heat from the internal combustion engine to mechanical power to drive the vapor recovery unit; and provide the one or more control signals to actuate a plurality of valves to regulate which respective heat exchangers to utilize to power the vapor recovery unit, wherein each respective thermomechanical cycle of a plurality of internal combustion engines comprises a respective heat exchanger to interface with a source of the excess heat, and the plurality of valves fluidly couple the respective heat exchangers to an expander coupled to the vapor recovery unit via a shaft.

9. The non-transitory computer-readable medium of claim 8, wherein the processor-executable code, when executed by the processor, causes the processor to monitor a status of the thermomechanical cycle to generate mechanical power for the vapor recovery unit.

10. The non-transitory computer-readable medium of claim 9, wherein the processor-executable code, when executed by the processor, causes the processor, when the vapor recovery unit is initially being powered by an alternative power source and when the thermomechanical cycle is generating sufficient mechanical power to drive the vapor recovery unit, to switch the vapor recovery unit from being powered by the alternative power source to being powered by the thermomechanical cycle to drive the vapor recovery unit.

11. The non-transitory computer-readable medium of claim 10, wherein during a transition from being powered by the alternative power source to being powered by the thermomechanical cycle, the vapor recovery unit is powered by both the alternative power source and the thermomechanical cycle.

12. A method for operating a vapor recovery unit, comprising:

receiving, at a controller, feedback from one or more sensors of a plurality of sensors disposed within a gas compression site or a combustible gas production site and monitoring a plurality of parameters related to a fugitive gas and/or an internal combustion engine;

providing, via the controller, one or more control signals to adjust an amount of mechanical power provided to the vapor recovery unit to compress the fugitive gas from the gas compression site or the combustible gas production site, wherein the mechanical power is provided from a thermomechanical cycle of the internal combustion engine that converts excess heat from the internal combustion engine to mechanical power to drive the vapor recovery unit;

monitoring, via the controller, a status of the thermomechanical cycle to generate mechanical power for the vapor recovery unit; and when the vapor recovery unit is initially being powered by an alternative power source and the thermomechanical cycle is generating sufficient mechanical power to drive the vapor recovery unit, switching, via the controller, the vapor recovery unit from being powered by the alternative power source to being powered by the thermomechanical cycle to drive the vapor recovery unit.

13. The method of claim 12, comprising:

providing, via the controller, the one or more control signals to actuate a plurality of valves to regulate which respective heat exchangers to utilize to power the vapor recovery unit, wherein each respective thermomechanical cycle of a plurality of internal combustion engines comprises a respective heat exchanger to interface with a source of the excess heat, and the plurality of valves fluidly couple the respective heat exchangers to an expander coupled to the vapor recovery unit via a shaft.

14. The method of claim 12, wherein during a transition from being powered by the alternative power source to being powered by the thermomechanical cycle, the vapor recovery unit is powered by both the alternative power source and the thermomechanical cycle.

15. A method for operating a vapor recovery unit, comprising:

receiving, at a controller, feedback from one or more sensors of a plurality of sensors disposed within a gas compression site or a combustible gas production site and monitoring a plurality of parameters related to a fugitive gas and/or an internal combustion engine;

providing, via the controller, one or more control signals to adjust an amount of mechanical power provided to the vapor recovery unit to compress the fugitive gas from the gas compression site or the combustible gas production site, wherein the mechanical power is provided from a thermomechanical cycle of the internal combustion engine that converts excess heat from the internal combustion engine to mechanical power to drive the vapor recovery unit; and providing, via the controller, the one or more control signals to actuate a plurality of valves to regulate which respective heat exchangers to utilize to power the vapor recovery unit, wherein each respective thermomechanical cycle of a plurality of internal combustion engines comprises a respective heat exchanger to interface with a source of the excess heat, and the plurality of valves fluidly couple the respective heat exchangers to an expander coupled to the vapor recovery unit via a shaft.

* * * * *